United States Patent [19]

Dönmez et al.

[11] 4,266,397

[45] May 12, 1981

[54] METHOD AND APPARATUS FOR RESTARTING INDIVIDUAL WINDING UNITS OF A RING SPINNING OR TWISTING FRAME

[75] Inventors: Atilla Dönmez; Wolfgang Igel, both of Ebersbach, Fed. Rep. of Germany

[73] Assignee: Zinser Textilmaschinen, Ebersbach, Fed. Rep. of Germany

[21] Appl. No.: 929,041

[22] Filed: Jun. 29, 1978

Related U.S. Application Data

[63] Continuation of Ser. No. 729,009, Oct. 4, 1976, abandoned.

[30] Foreign Application Priority Data

Oct. 3, 1975 [DE] Fed. Rep. of Germany ..... 2544319

[51] Int. Cl.³ ..... D01H 15/00; D01H 7/56; D01H 7/58; D01H 1/24

[52] U.S. Cl. ..... 57/261; 57/75; 57/78; 57/88; 57/93; 57/94; 57/102; 57/103; 57/124

[58] Field of Search ..... 57/75, 78, 93, 94, 102, 57/100, 119, 103, 120, 122, 124, 88, 276–278, 261–263

[56] References Cited

U.S. PATENT DOCUMENTS

| | | | |
|---|---|---|---|
| 2,541,238 | 2/1951 | Goree | 57/124 |
| 2,563,187 | 8/1951 | Pennati | 57/124 |
| 3,067,565 | 12/1962 | Jackson | 57/278 |
| 3,324,643 | 6/1967 | Kluttz | 57/124 |
| 3,338,045 | 8/1967 | Kaiser | 57/120 |
| 3,494,120 | 2/1970 | Chilpan et al. | 57/122 X |
| 3,540,200 | 11/1970 | Tsukumo et al. | 57/262 |
| 3,543,503 | 12/1970 | Watabe et al. | 57/124 |
| 3,664,109 | 5/1972 | Escursell-Prat | 57/261 |
| 3,673,780 | 7/1972 | Merck | 57/261 |
| 3,738,094 | 6/1973 | Costales et al. | 57/124 X |
| 3,785,140 | 1/1974 | Muller | 57/124 X |
| 3,851,448 | 12/1974 | Sano et al. | 57/124 X |
| 3,866,404 | 2/1975 | Doleman et al. | 57/120 X |
| 3,868,815 | 3/1975 | Stahlecker | 57/88 |
| 4,023,342 | 5/1977 | Schenkel | 57/124 X |

*Primary Examiner*—John Petrakes
*Attorney, Agent, or Firm*—Edwin E. Greigg

[57] ABSTRACT

On a ring spinning or twisting frame having winding units with rotatable thread follower rings, the difference in the speed of rotation between the ring and its follower during the restarting of the winding unit, after repair of a thread break, is maintained within acceptable limits while the frame continues to run at its high operational speed, by controlling the rotational speed of either the ring or the spindle, the speed of the controlled element being varied either continuously, or in one or more steps during the restarting operation.

12 Claims, 6 Drawing Figures

FIG.1
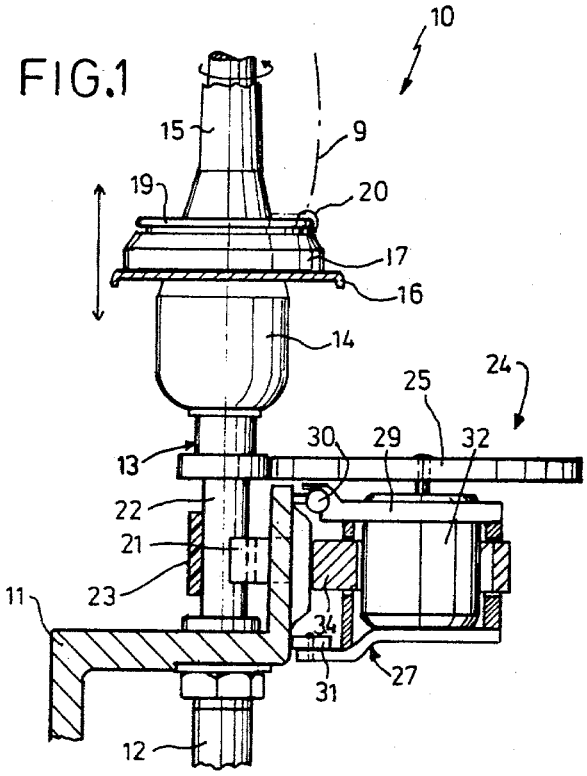
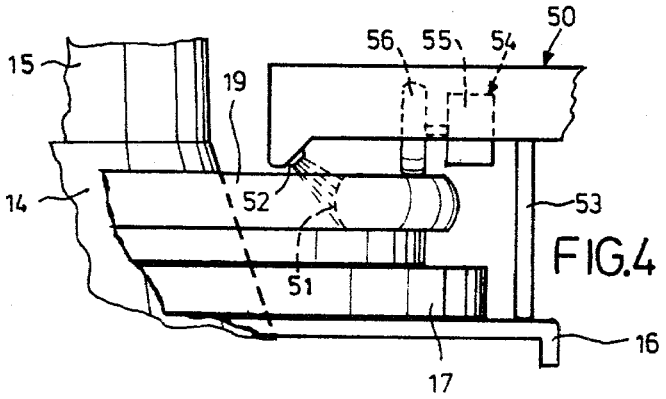
FIG.4

METHOD AND APPARATUS FOR RESTARTING INDIVIDUAL WINDING UNITS OF A RING SPINNING OR TWISTING FRAME

This is a continuation, of application Ser. No. 729,009, filed Oct. 4, 1976, now abandoned.

BACKGROUND OF THE INVENTION

1. Field of the Invention

The invention relates generally to textile ring spinning or ring twisting frames having winding units with rotatably mounted thread follower rings, particularly to a method and apparatus for restarting an individual winding unit of such a frame without slowing or stopping the other winding units of the frame.

2. Description of the Prior Art

Rotatably mounted rings, as compared to nonrotatably mounted rings, are advantageous in that they allow operation of the spindles at considerably higher speeds and thus increased production.

This is especially true for air cushioned rings. The invention therefore relates especially to air cushioned rings including both aerostatic and aerodynamically mounted rings. In the case of aerostatic bearings, the bearing is acted upon by externally supplied air, whereas in the case of aerodynamic bearings, the air cushion is formed by the auto-rotation of the rotatable part of the bearing.

In such machines, a problem that hitherto has not been solved satisfactory is that of how to bring the pertinent winding units again up to the operational speed after a thread break without danger of a new thread break or damage of the ring. In these machines, normally all spindles, or at least the spindles on one longitudinal side of the machine, are driven in common by a tangential belt or by small belts driven jointly be a single drum. Thus, any spindle, which has been stopped either by hand or by means of a spindle brake for the purpose of correcting a thread break upon being released, will accelerate quickly to its operational speed which, at least in the case of air cushioned rings, is so high that the traveler dragged by the thread revolves on the ring at an impermissibly high speed relative to the ring. Consequently, the traveler can wear down extremely quickly and break and the traveler path of the ring can be damaged, or the thread can break as a result of too high a thread tension. Even though the traveler drives the ring, the ring is accelerated only relatively slowly by the traveler and thus will reach its high operational speed relatively slowly, whereas the traveler will reach a very high speed relatively quickly since it is driven directly by the spindle by way of the thread. In most instances, the speed of the traveler is only relatively slightly lower than the speed of the spindle. For example, with air cushioned rings, one can achieve spindle speeds of 20 000 rpms and more, so that the traveler at such high rpms is exposed to extremely great centrifugal forces and, because of the slow acceleration of the ring, will rotate for a relatively long time at impermissibly high speeds. Even for air cushioned rings, the relative speed between the traveler and the ring must not be essentially higher than that of non-rotatably disposed rings so that, for example, only relative rpms of 8000–12 000 rpms are permissible.

Whenever the entire ring spinning or twisting machine accelerates from standstill, then the problem of acceleration had been solved by allowing the machine to accelerate to its operational speed only relatively slowly so that no impermissibly high relative rpms occurred between the travelers and the rings. But, whenever during the subsequent standard operation, thread breaks on individual spinning or twisting positions are to be eliminated, the entire machine could be stopped per se before restart of the particular winding unit or it could be allowed to run more slowly. However, in view of the large number of spinning and twisting units which such machines have, either stopping or operating the machine at a reduced speed during the repair of each and every thread break could cause a high loss of production. Until now, the only alternative left was to delay the repair of the thread breaks until the end of the pertinent pull off on the spinning and twisting units where thread breaks occurred; as a result the pertinent spinning or twisting units were eliminated for the further production during this pull off, which naturally is likewise very disadvantageous.

OBJECTS AND SUMMARY OF THE INVENTION

Therefore, it is a primary object of the invention to provide a method and apparatus for restarting any individual winding unit of a ring spinning or ring twisting frame after repair of a break that occurred on the individual winding unit, without diminishing the high operational speed of the frame, and without over-straining the thread, traveler or ring during the restarting.

As a result of this process according to the invention, a single winding unit can be made to restart without over-straining of the thread, the traveler and the ring, which is required especially in connection with the elimination of a thread break, without thereby influencing the running of the remaining spindles so that on all remaining winding units, the winding continues uninterruptedly at the full operational speed. In the case of a preferred further development, provision has been made at the same time to drag the traveler by the thread at a decreased output for a limited time, until the speed of the ring has surely risen to a value such that the permissible value of relative speed between the traveler and the ring can no longer be exceeded as the output is increased to normal. The ring will be accelerated by the traveler for such a length of time until finally synchronous running occurs between the traveler and the ring, i.e., the traveler is stopped on the ring because of its great centrifugal force with which it is pressed against the ring. At the same time, provision may effectively be made to allow the synchronous run between the traveler and the ring to occur at a speed of the spindle which is considerably below the operational speed and then to allow the speed of the spindle to slowly increase while maintaining the synchronous running of the traveler and the ring up to the operational speed. The process according to the invention can be carried out in different ways, since there are various methods and means during the restarting period to drive the traveler from the thread at a decreased output. At the same time, in the case of a rotating spindle, it will be necessary to drive the traveler continuously by the thread, since otherwise the thread tension would be lost and grabbing of the thread on the bobbin would occur. Therefore, the process must not be carried out in such a way that the thread does not exert any drive whatever on the traveler.

By restart of the winding up unit is meant the restart of the spindle until it reaches its operational speed.

Furthermore, by "decreased driving output" of the thread on the traveler, is meant that this driving output is smaller than if the restart were carried out in such a way that the spindle would be allowed to restart freely from stand-still through its operational drive and the ring at the same time would be driven exclusively by way of the thread by the traveler.

In the case of a preferred embodiment of the process, provision is made that the maximum relative speed between the traveler and the ring occurring during the restart of the spindle is keep considerably below the operational speed of the spindle, i.e., to such values which will not cause any overload on the thread, traveler and ring. This can be achieved in various ways.

It is particularly advantageous to achieve this by increasing the spindle speed in such a way, that the relative speed between the traveler and the ring does not exceed permissible values. In the case of a preferred embodiment, this can be achieved by slowly and steadily increasing the spindle speed sufficiently so that during this slow acceleration of the spindle, no impermissibly high relative speeds occur between the traveler and the ring.

In the case of another advantageous embodiment, provision has been made for the spindle speed to be increased quickly up to an intermediate speed lying considerably below the operational speed, and then held at this intermediate speed for a sufficient period of time. This process will be advantageous, especially whenever the operational speed is no more than about twice as large as the permissible relative speed between traveler and ring. In this case, one can provide an intermediate speed, which corresponds with a sufficient tolerance to almost the permissible maximum relative speed between the traveler and the ring, and allow the spindle to rotate at this intermediate speed until the ring rotates almost at the speed of the traveler. Then, one can allow the spindle to be accelerated by its standard drive quickly to its operational speed or, alternatively, one can allow this second part of the rise in speed of the spindle to take its course so slowly that there will be a synchronous running between the traveler and the ring. Possibly one can also provide that the spindle quickly increases from the above-mentioned intermediate speed to a second higher intermediate speed and here again allow this second intermediate speed to continue for a time and only then to move up to the operational speed or a third intermediate speed.

In another advantageous embodiment of the invention, provision has been made to additionally drive the ring by a driving power supply not transferred by way of the traveler. In that case, however, one must be careful that the ring does not rotate more quickly than the traveler, because otherwise grabbing of the thread on the bobbin will occur. To prevent such grabbing of the thread, the additional ring drive is accomplished in such a way that a predetermined relationship of the spindle speed to the ring speed is maintained. This can be accomplished simply by coupling the additional ring drive in the gear system with the spindle and by providing a suitable step-down gear. However, it is also possible, even though constructionally normally more expensive, to drive the ring additionally in some different way, for example, by means of a drive having a motor of its own. In this case, there are numerous possibilities in order to take care that the ring on the one hand cannot rotate faster than the traveler, and on the other hand, that a maximum permissible relative speed between the traveler and the ring is not exceeded, for example, by synchronization of this motor with the spindle speed of the pertinent spindle and suitable reduction, or by an approximately equally quick acceleration of the motor, phase-shifted in relation to the spindle speed, etc.

In the case of yet another preferred embodiment, spindle driving means have been provided which are capable of starting (driving) the spindle with at least a lower rpm, than as a result of its normal drive. These spindle driving means may include a driving motor or else provision can also be made to allow the spindle drive to be accomplished by the belt or tangential belt normally driving the spindle, by providing a step-down gearing which is driven on the input side by this belt or tangential belt and which drives the spindle on the output side. This step-down gear can be given a particularly simple construction by having only a single reduction, but it is also possible to develop it as a changeover gear with several speeds or else as a continuously variable gear. In the latter case, this step-down gear makes it possible to increase the speed of the spindle slowly by continuous change of the gear reduction ratio.

At the same time, a spindle brake which is assigned in any case to the spindle can serve as a slowly or intermittently actuated brake. In another preferred embodiment, the brake is developed as a power consumer driven by the spindle. This power consumer can be a power converting gear mechanism, preferably a fluid drive, with either a stationary output drive or a flywheel.

In another preferred further development, provision has been made to provide a driving arrangement for driving the ring. This driving arrangement too, may advantageously have a step-down gear, which can be driven by either the spindle drive or by the spindle, and which on the output side drives the ring by means of a friction roll, which is pressed against the ring. It is, however, also possible to assign a motor of its own to this driving arrangement.

Whenever a layer of lubricant is applied to the running path of the traveler of the ring in order to decrease the output of the drive of the traveler by the thread, this lubricant layer considerably decreases the friction coefficient between the traveler and the ring. This application of lubricant may be accomplished preferably by means of a spraying arrangement. In the case of spraying onto the ring, a spray nozzle can be preferably directed in such a way that the thread winding body on the pertinent spindle will not also be sprayed. Either a single spray nozzle or several spray nozzles can be provided. Also, lubricant can be applied by means of a wiping body saturated with the lubricant or in some other suitable manner. It is particularly effective to apply the film of lubricant before restarting the spindle, wherein a driving arrangement turns the ring before its restart and during this turning of the ring the spray nozzle sprays continuously or intermittently. The spraying of lubricant onto the path of the traveler of the ring may be directed from above or below the path. In some cases, the spraying may be directed from a diameter plane of the path of the traveler, for example, tangentially or radially, especially whenever provision is made that spraying will take place only whenever the ring is located near the upper end of the truncated cone-shaped upper area of the thread winding body, so that a considerable inside distance exists between the ring and the thread winding body. A uniform spraying of the ring can also be provided while the ring is stopped, for example by suitably moving the spray nozzle while, at the same time, spraying continuously or intermittently.

The invention will be better understood as well as other objects and advantages thereof become more apparent from the following detailed description of the invention taken in conjunction with the drawing.

BRIEF DESCRIPTION OF THE DRAWING

FIG. 1 shows a partial, cross-sectional side view of a winding unit of a ring spinning or ring twisting machine;

FIG. 4 shows a partial cross section through a ring with an apparatus for spraying a lubricating film.

DESCRIPTION OF THE PREFERRED EMBODIMENT

Figure 3:
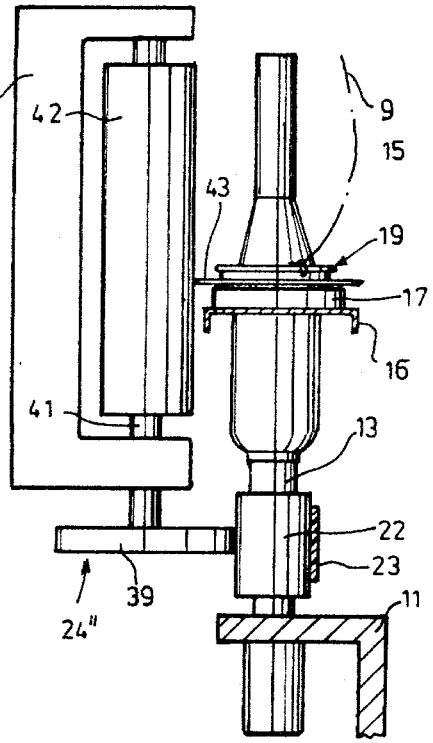
FIG. 3 is a side view of a winding unit in which the ring is driven by the spindle.

The winding unit 10 shown in side view in FIG. 1 has a spindle 13 mounted rotatably in a bearing housing 12 attached on a stationary spindle rail 11, within a casing 15 and having a thread winding body 14 and a ring 19, air cushioned in a bearing 17, attached on a ring rail 16, which can be moved up and down, on which a traveler 20 can rotate, dragged by a thread 9 running from a delivery mechanism, not shown, to the thread winding body 14. A customary mechanical spindle brake 21 is also disposed on the spindle rail 11, which serves for braking the speed of the spindle 13 down to a stop. The spindle 13 in standard operation is driven by a tangential belt 23 fitting against its whorl 22, which belt 23 also drives at least the remaining spindles of the row of spindles on this side of the machine.

In order to make possible the restarting of this winding unit 10, which is required in the course of an elimination of a thread break with a decreased operating output of the thread on the traveler 20, while avoiding an overload on the thread, the traveler 20 and the ring 19, in this preferred embodiment, a separate spindle drive arrangement has been releasably provided on any given winding unit of this machine. This spindle drive arrangement 24 alone determines the speed (rpm) of the spindle 13 as long as it drives the spindle 13. The running tangential belt 23 at the same time can remain fitting against the spindle 13 or else it can be lifted off. Naturally, in the first case, the contact pressure of the driving wheel 25 against the whirl of the spindle 13 must be great enough so that the rpm of the spindle 13 is determined solely by the driving wheel 25.

This driving arrangement 24 may be moved into position by the operating individual eliminating the thread break and can be attached at every winding unit 10 whenever he eliminates a thread break. However, it is also possible, to dispose this driving arrangement 24 on a thread piecing carriage, moving along the machine and automatically eliminating thread breaks, and to control it from the piecing carriage together with its remaining equipment serving for the elimination of the pertinent thread break.

The driving arrangement 24 has a frame 27 which has, below the driving wheel 25, two arms of a fork 29 of which one can be seen, whereby the prongs of the fork are developed such that they can be stuck onto a horizontal bolt 30 attached to it and extending in longitudinal direction of the spindle rail 11. On the bottom side, the frame 27 carries at least one roll 31 with a vertical rotational axis which fits against a vertical front surface of the spindle rail 11, so that the operating position of this driving arrangement 24 is precisely determined.

In the event that this driving arrangement 24 is disposed on a thread piecing carriage, it can be horizontally adjusted on it by a motor on the spindle rail 11 up the terminal position provided. On the other hand, in case that the spinner manually guides this driving arrangement, provision might be made that the prongs 29 of the fork are developed in the form of hooks in front, so that this driving arrangement 24 will keep automatically in the suspended position.

Furthermore, in case that the operator manually guides this driving arrangement 24, it must be possible for the motor 32 of the driving arrangement 24 to be connected to an electric supply at the pertinent winding up unit, which can be accomplished, for example by application of a contact to a live rail (bus bar) placed along the spindle rail 11, or else by a plug bog connection, etc.

In a particularly advantageous case, the motor 32 can be a variable speed motor, the rpm of which is continuously variable between zero and the maximum rpm. In another embodiment, the motor 32 may be an electric motor running at only a single operational speed.

Subsequently, the restarting of the spindle 13 will be described in the case of the elimination of a thread break by an automatic carriage. The starting carriage, after it has found a thread break on the winding up unit, will stop, search for the broken end of the thread on the thread winding body 14, and then eliminate the thread break in the customary known manner. At the same time, the restarting of the spindle 13 takes place first of all by means of the driving arrangement 24 and not by means of the tangential belt 23. In case the spindle must be driven backward or forward during the preceding search for the broken end of the thread at a decreased speed, then this driving arrangement 24 can effectively execute this too. For the restart of the spindle 13, and in the case of a continuously speed controllable motor 32, one will effectively proceed in such a way that this motor 32 will steadily increase the spindle speed so slowly that not too great a relative rpm can occur between the traveler 20 and the ring 19, which could lead to overloadings of the thread, traveler 20 and ring 19. In this respect it will generally be enough that this relative rpm should not, for example, exceed half the operating speed of the spindle.

During the restart, the traveler 20 rotates on the ring 19 and drives it as a result, so that the rpm of the ring 19 increases slowly and steadily. In case of a start up spindle speed which lies below the operational speed of the spindle 13, provision can be made that after a predetermined time the drive of the spindle by the driving arrangement 24 be concluded by removing it and turning off the motor, so that then the tangential belt 23 will again bring the spindle 13 from its intermediate rpm very quickly up to the operational rpm. Also, in many cases, the motor 32 can be advantageously controlled in such a way that it increases the spindle rpm slowly up to the operational rpm.

In the case where the operator controls the motor 32, advantageously a manually operable operating button for controlling the rpm, can be disposed on the driving arrangement 24, whereby the operator can visually control the motor 32 in a suitable manner on the basis of his experience. Whenever the motor 32 has only a single rpm operating, then this can be made effectively in such a way, that the driving arrangement 24 drives the spindle 13, say at half its operating speed. In that case, the restart takes place in such a way that after release of the spindle brake 21, the motor 32 quickly raises the spindle 13 to the intermediate rpm determined by it and then drives the spindle for a sufficiently long time at this intermediate rpm which is made in such a way, that a synchronous running will at least be almost achieved or will occur between the traveler and the ring. The driving arrangement 24 is then removed and turned off and the spindle is then accelerated by the tangential belt 23 quickly to its operating speed. Provision can also be made that the motor 32 is developed in such a way, that it delivers at least two different operational speeds for the spindle 13, for example it may be a pole-convertible motor or it may include a suitable shifting gear for the adjustment of several different driving speeds. In the case of several discrete driving rpms, the spindle 13 first of all is driven with the lowest driving rpm for some time and then it is switched over to the second higher driving rpm and maintains this also for some time, whereupon then the driving arrangement 24 is removed and the spindle 13 is accelerated by the tangential belt 23 to its operating speed. Alternatively, a continuously shiftable gear can be disposed between the motor 32 and the driving wheel 25, to smoothly and slowly accelerate the spindle 13 to its operating speed.

Figure 5:
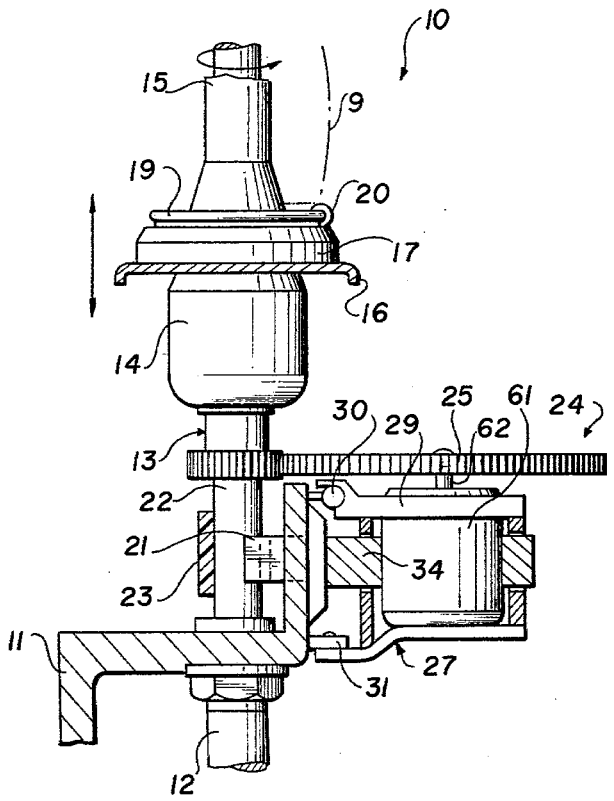
FIG. 5 is a view similar FIG. 1 illustrating a modification of the winding unit of the invention.

It is also possible to employ an energy consumer driven by the wheel 25 instead of the motor 32 and otherwise to leave the driving arrangement unchanged, which then, however, is no longer a driving arrangement. The energy consumer, identified in FIG. 5 by the reference numeral 61 can be, for example, an energy converter gear, preferably a fluid gear having an input shaft 62 with a stationary driving part. This energy consumer is to be developed in such a way, that it removes a considerable portion of the driving energy transferred from the tangential belt to the spindle, from said spindle through the drive via the drive of the wheel 25, so that the spindle 13 can increase its rpm only so slowly that no overload of the thread, traveler and ring can occur.

In the case of a variation not shown, the frame 27 does not carry a driving motor 32 or an energy consumer and also it does not carry a wheel 25 which can be pressed against the spindle, but only a control arrangement for the operating member 34 of the spindle brake 21, mounted in the frame 27 which is controlled automatically, for example by means of a program or by means of a regulator, in such a way that the restarting of the spindle 13 will take place sufficiently slowly by a suitable braking of the spindle 13. This braking can take place as a result of either a steady, slow application of the brake or an intermittent operation of the brake, whereby possibly a measuring arrangement may also be disposed on the frame which measures the spindle rpm (speed). This measuring instrument is then the supplier of the actual value for a regulator which regulates the rpm of the spindle by braking.

Figure 2:
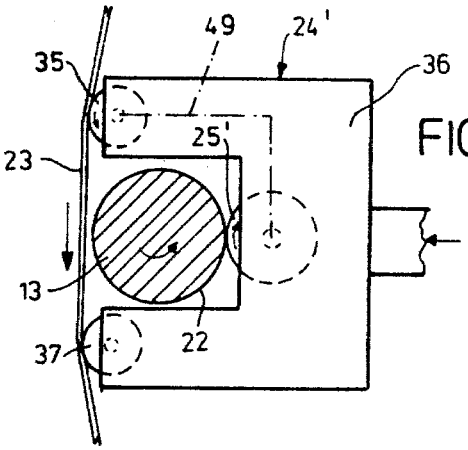
FIG. 2 shows a top view of a second embodiment of a spindle drive arrangement according to the invention, whereby the spindle is shown in cross section.

In the embodiment shown in FIG. 2, the spindle 13 is driven again for the restart by means of a driving arrangement 24', which has a friction wheel 25' pressed against the whorl 22 of the spindle 13. The friction wheel 25' is connected via a gearing, symbolized by an effective line 49, with a driving wheel 35 pressed against the tangential belt 23, which normally drives the spindle 13. This gearing is accommodated in a fork-shaped housing 36 which, in addition, carries a freely rotatably mounted roll 37 which, together with the wheel 35, serves for lifting off the tangential belt 23 from the spindle 13. This driving arrangement 24' therefore drives the spindle 13 by means of the tangential belt 23 during the restart for a time at an intermediate rpm lying considerably below the operational rpm of the spindle, so that this driving arrangement does not have to have a motor of its own and thereby is considerably cheaper and also has a much lower weight. It can be operated manually or even automatically by a thread piecing carriage carrying it. As soon as the driving arrangement 24' is taken off, the tangential belt 23 again fits against the spindle 13 and takes over its drive at the operational speed.

In the embodiment shown in FIG. 3, the spindle 13 is likewise driven by the tangential belt 23, which in this case fits continuously against the spindle 13. During the restart of the spindle 13, the tangential belt 23 raises the spindle 13 very quickly to its operational speed. In this embodiment, provision has been made for the ring 19 to be driven at an rpm proportional to the rpm of the spindle 13 during the restart of the spindle 13 in order to prevent an overload of the thread, traveler and ring, which ring rpm is somewhat smaller than the rpm of the traveler to be sure that the ring 19 will rotate more slowly than the traveler 20 dragged by the spindle 13 by means of the thread. For this purpose, the driving arrangement 24'', which can either be set up by hand or disposed on a thread piecing carriage, has a driving disc 39 which can be pressed against the whorl 22 of the spindle, on the vertical shaft 41 of which, mounted rotatably in a fork 40, a long friction roller 42 is disposed which is pressed against a flange 43 of the ring 19 projecting forward beyond the ring rail 16 for the purpose of driving said ring and which may effectively have a soft coating of rubber or plastic in order to load the ring 19 only with such a radially directed force as is required for its drive. At the same time, stops which have not been shown, may be provided which will guarantee a predetermined distance between the rotational axis of the spindle 13 and the rotational axis of the shaft 41. Also, the friction roll 42 is sufficiently long so that it will be capable of driving the ring 19 in every position of the stroke of said ring occurring during operation.

In the embodiment shown in FIG. 4, a lubrication spraying arrangement 50 has been provided by means of which the inner surface 51 of the ring 19 is provided with a film of lubricant prior to restarting of the spindle. This film considerably decreases the friction coefficient between the traveler and the ring 19 and lasts long enough, so that during the restart of the spindle, no overload of the thread, traveler and ring 19 will occur.

If necessary, the spraying can be repeated one or more times after starting the spindle. In particular, molybdenum, disulfide or polytetrafluoroethylene can be used as a lubricant; however other lubricants can also be used which bring about the required low friction coefficients.

In this embodiment, the spraying arrangement 50 has a single spray nozzle 52. The spraying arrangement, in its operating position, is above the ring 19 and is advantageously at a smaller distance from the rotational axis of the spindle than the inner surface 51. Preferably, provision is made so that spraying takes place only whenever the ring 19 is at the level of the upper end of the thread winding body 14, by having the ring rail itself trigger the spraying by operation of the valve member 53 to thus prevent a simultaneous spraying of the thread winding body 14. It can also be provided that during the spraying, while the thread break still exists, the spindle is allowed to continue to run at full operational speed, so that the wind produced by it will prevent the sprayed lubricant to reach the thread winding body. In case that this spraying arrangement 50 is operated by an attendant, he can drive said ring 19 manually, or else in this embodiment, the ring 19 is rotated during the spraying by a driving arrangement 54, which has a small electric motor 55 which drives a disc 56 which is pressed against a flange of the ring 19 radially in relation to its drive.

Figure 6:
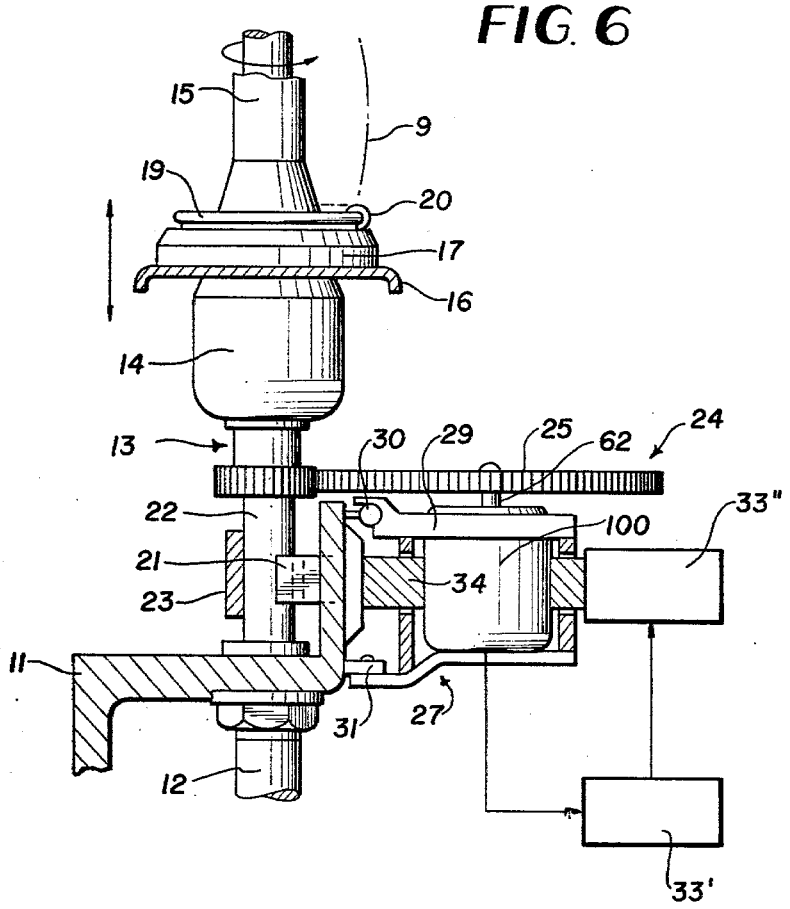
FIG. 6 is a view similar to FIG. 1 illustrating a further modification of the winding unit of the invention.

In the embodiment of FIG. 6, wherein like numerals are used to identify like parts, the winding unit of the invention includes a tachogenerator 100, which provides the actual value of the rpm of the spindle 13. This rpm actual value is fed to a controller 33', which, in a known manner, provides a control deviation between a predetermined set-point value of the spindle rpm and the measured actual value. The set-point value corresponds to a reduced spindle rpm which is below the operating rpm of the spindle and is selected so that an overload cannot occur while the spindle is accelerated up to the operational speed of the rotatably supported ring 19. The controller 33' may be a two-point controller. If the actual value of the spindle rpm is larger than the set-point value, then the controller 33' energizes an electromagnet 33" which presses the actuating member 34 of the spindle brake 21 to the left, as viewed in FIG. 6, so that the spindle brake 21 is actuated. If the actual value of the spindle rpm is below the set-point value, the electromagnetic 33" is de-energized and the spindle brake is released, i.e., does not brake. This control of the reduced spindle rpm takes place during the acceleration of the spindle from standstill for a sufficiently long period.

Other advantageous arrangements of the spray nozzle can consist in the fact, that it will spray at the traveler path 51 from the inside of the ring or from a position below the ring rail.

It is also possible to assign fixedly a separate spraying nozzle to the ring 19 on a machine, which is fixedly disposed on the ring rail.

What is claimed is:

1. Apparatus for restarting, following a thread break, an individual winding unit of a running ring spinning or twisting machine of the type having a plurality of driven spindles, each surrounded by a rotatable ring supporting a traveler for free rotation thereon, comprising:

spindle drive means positionable into engagement with any preselected spindle for driving said spindle in its normal rotational thread winding direction independently of the normal drive means of the machine; and means for activating said drive means to drive said spindle at speeds up to the normal operating speed of the normal drive means of the machine until the relative rpm between the traveler and the ring can no longer exceed a predetermined limit.

2. Apparatus as defined by claim 1 in which said last-mentioned means is an electric motor.

3. Apparatus as defined by claim 2 in which said electric motor is of the variable speed type.

4. Apparatus as defined by claim 1 in which said last-mentioned means includes a speed reducing gearing driven by the normal spindle drive for the machine.

5. Apparatus as defined by claim 4 including means operative in conjunction with said speed reducing gearing for disengaging the normal machine drive to said preselected spindle when said apparatus is positioned to drive said spindle.

6. Apparatus for restarting, following a thread break, an individual winding unit of a running ring spinning or twisting machine of the type having a plurality of driven spindles, each surrounded by a rotatable ring supporting a traveler for free rotation thereon, comprising:

a frame;

an elongated roll having a soft coating thereon;

a shaft rigidly connected to and mounting said roll for rotation in said frame;

a drive disc of larger diameter than said roll secured to said shaft at a point spaced from said roll so that said frame is positionable with respect to an individual winding unit to engage said disc with the spindle and said roll with the ring to drive said ring at a speed less than said spindle.

7. The method for restarting, following a thread break, of an individual winding unit of a running ring spinning or twisting machine of the type having a plurality of driven spindles, each surrounded by a rotatable ring supporting a traveler for free rotation thereon, the steps comprising:

without disturbing operation of the other winding units, braking the spindle having the broken thread to a stop;

repairing the thread break;

subsequent to repairing said thread break driving said spindle in its normal rotational thread winding direction independently of the normal machine drive at a speed less than the normal spindle speed until the difference in speed between the ring and traveler is less than a predetermined value; and discontinuing the independent spindle drive and permitting the normal machine drive to accelerate the spindle to normal machine speed to prevent excessive tension in the thread during the restarting procedure.

8. A method as defined by claim 7 in which the acceleration of the spindle during the independent drive thereof is controlled to prevent the relative speed of the ring and traveler from exceeding a predetermined value.

9. In an apparatus for restarting, following a thread break, an individual winding unit of a running ring spinning or twisting machine of the type having a plurality of driven spindles, each surrounded by a rotatable ring supporting a traveler for free rotation thereon, the improvement comprising:

a spindle brake;

control means for actuating the spindle brake to engage the spindle and automatically controlling braking of the spindle at speeds less than the operational speed of the spindle and for a time sufficient to prevent the relative speed of the traveler and ring from exceeding a permissible limit;

spindle drive means positionable into engagement with any preselected spindle for driving said spindle in its normal rotational thread winding direction independently of the normal drive means of the machine; and means for activating said drive means to drive said spindle at speeds up to the normal operating speed of the drive means of the machine until the relative rpm between the traveler and the ring can no longer exceed a predetermined limit.

10. Apparatus for restarting, following a thread break, an individual winding unit of a running ring spinning or twisting machine of the type having a plurality of driven spindles, each surrounded by a rotatable ring supporting a traveler for free rotation thereon, comprising:

a power consumer including a power converter gear or flywheel for influencing the driving output of the thread; and coupling means for coupling the power converter gear or flywheel to the spindle to allow the power converter gear or flywheel to be driven by the spindle, whereby the power consumer consumes a large part of the driving power transmitted to the spindle.

11. An apparatus as described in claim 9 wherein said spindle brake control means releases the spindle brake slowly.

12. An apparatus as described in claim 9 wherein said spindle brake control means operates the spindle brake intermittently.

* * * * *